US005462642A

United States Patent [19]

Kajander

[11] Patent Number: 5,462,642

[45] Date of Patent: Oct. 31, 1995

[54] METHOD OF FORMING A FIBROUS MAT

[76] Inventor: Richard E. Kajander, 331 N. Dulton, Toledo, Ohio 43615

[21] Appl. No.: 123,019

[22] Filed: Sep. 16, 1993

[51] Int. Cl.[6] ..... D21F 11/00

[52] U.S. Cl. ..... 162/116; 162/109; 162/145; 162/152; 162/156; 162/211; 162/296; 162/903

[58] Field of Search ..... 162/109, 116, 162/296, 145, 152, 156, 903, 211

[56] References Cited

U.S. PATENT DOCUMENTS

| | | | |
|---|---|---|---|
| 1,616,222 | 2/1927 | Harrigan | 162/116 |
| 3,103,461 | 9/1963 | Smith et al. | 162/156 |
| 3,322,617 | 5/1967 | Osborne | 162/296 |
| 3,350,260 | 10/1967 | Johnson | 162/296 |
| 3,969,561 | 7/1976 | Marshall | 428/113 |
| 4,070,235 | 1/1978 | Marshall | 162/116 |
| 5,098,519 | 3/1992 | Ramasubramanian | 162/113 |
| 5,158,824 | 10/1992 | Gill et al. | 162/109 |

*Primary Examiner*—Peter Chin

[57] ABSTRACT

A method of producing a nonwoven fiber glass mat that contains discrete areas which are of different construction than the remainder of the mat. The permeable forming screen onto which a fibrous aqueous slurry is deposited is of a different structure in areas corresponding to the discrete areas of the mat so as to restrict the flow of water through those areas. Less fiber is deposited in those areas, resulting in the discrete areas being comprised of a thinner mat. The orientation of fibers within the discrete areas can be controlled by correlating the restricted flow of slurry in these areas to the flow of slurry necessary to cause this condition.

7 Claims, 2 Drawing Sheets

METHOD OF FORMING A FIBROUS MAT

FIELD OF THE INVENTION

This invention relates to the manufacture of nonwoven fibrous mats. More particularly, it relates to a method of forming fiber glass mats containing discrete areas which have different characteristics or properties from the main body of the mat.

BACKGROUND OF THE INVENTION

Nonwoven fiber glass mats are conventionally produced by dispersing glass fibers in chemically treated water to form an aqueous slurry stock, depositing the slurry onto a foraminous forming belt, such as the chain or wire of a Fourdrinier machine, while the belt is moving through a fiber deposition zone, and drawing water from the slurry through the belt to cause a layer of fiber to remain on the belt. The slurry stock is brought to the moving belt in quantities correlated to the speed of the belt to produce a mat comprised of fibers which are oriented in a predetermined manner. For example, if the stock is introduced to the moving wire at a relatively slow rate compared to the speed of the wire, the fibers become oriented in the machine direction. If the stock is introduced at a relatively fast rate compared to the speed of the wire, the fibers are distributed on the wire in random orientation. While both directionally and randomly oriented mats are suited for various types of applications, it would be beneficial in some applications to have a mat which contains separate areas of different character.

U.S. Pat. No. 3,969,561 discloses an air-borne method of forming a nonwoven fibrous mat which involves the use of either impervious bars disposed over a forming screen or impervious areas incorporated into the screen. Fibers are thereby prevented from being deposited on the screen beneath the bars or in the impervious areas of the screen. The impervious bars or screen areas extend throughout the entire fiber deposition zone so that at no point does the stream of fibers encounter an area which is completely unblocked. The dimensions and spacing of the impervious bars or areas are such that fibers falling on them are able to bridge across to the unblocked areas. In that way a mat is formed continuously across the width of the screen, with the fibers in the portions of the mat corresponding to the adjacent blocked and unblocked areas of the screen being at right angles to each other. The method is disclosed in connection with the manufacture of decorative striped fabrics.

U.S. Pat. No. 4,070,235 discloses a method for making a nonwoven fibrous mat from an aqueous slurry by utilizing fluid impervious bars to block portions of a forming screen or by incorporating fluid impervious blocking means into the forming screen. Fibers of different lengths are used to obtain the desired bridging effect. The impervious bars or screen areas extend throughout the entire fiber deposition zone, as in the disclosure of U.S. Pat. No. 3,969,561. The product produced is similar to the product produced by the method of U.S. Pat. No. 3,969,561.

The mats produced by these methods are restricted in design to the configurations made possible by the method of production. It would be desirable to be able to produce nonwoven mats having different and more varied designs incorporated into the body of the mat. It would also be beneficial to be able to produce a mat which has areas of different physical properties so as to be especially suited for certain specific types of installations, making it possible to customize a mat depending on its intended use.

BRIEF SUMMARY OF THE INVENTION

The method of the invention is an improvement to the conventional method of forming a nonwoven fibrous mat of generally random fiber orientation. Typically, such mats are produced by forming an aqueous fibrous slurry, depositing the slurry onto a permeable or foraminous support while the support is moving through a fiber deposition zone, and drawing water from the slurry through the foraminous support to cause a layer of fibers from the slurry to remain on the support. The layer of fibers is dried and removed from the support to form the final mat product. The fibers can be inorganic, such as glass fibers, or organic fibers or mixtures of inorganic and organic fibers.

In accordance with the invention, discrete areas of the permeable support are modified to restrict the flow of water therethrough compared to adjacent areas of the support while still maintaining enough flow to permit the deposition of fibers from the slurry in the discrete areas. This results in a lesser quantity of fiber deposited per unit area of the restricted portions of the permeable support than in adjacent areas. The mat is thus thinner in the discrete areas of the mat than in adjacent areas, and the fibers within the discrete areas may be oriented in a predetermined direction.

The flow of water through the discrete areas of the permeable support may be restricted in varying degree by any suitable means capable of being implemented on the particular permeable support employed. For example, flow may be restricted by coating or pattern printing the wires of a forming screen in the discrete restricted-flow areas with a substance which makes the discrete areas less permeable to water than the untreated areas.

The resulting mat has areas which are different than the rest of the mat. They may provide a decorative effect or they may have improved physical properties particularly suitable for certain service requirements. In addition, the method of the invention is simple and economical to implement in commercial manufacturing operations.

The above and other aspects and benefits of the invention will readily be apparent from the more detailed description of the preferred embodiments of the invention which follows.

DETAILED DESCRIPTION OF THE PREFERRED EMBODIMENTS

Figure 1:
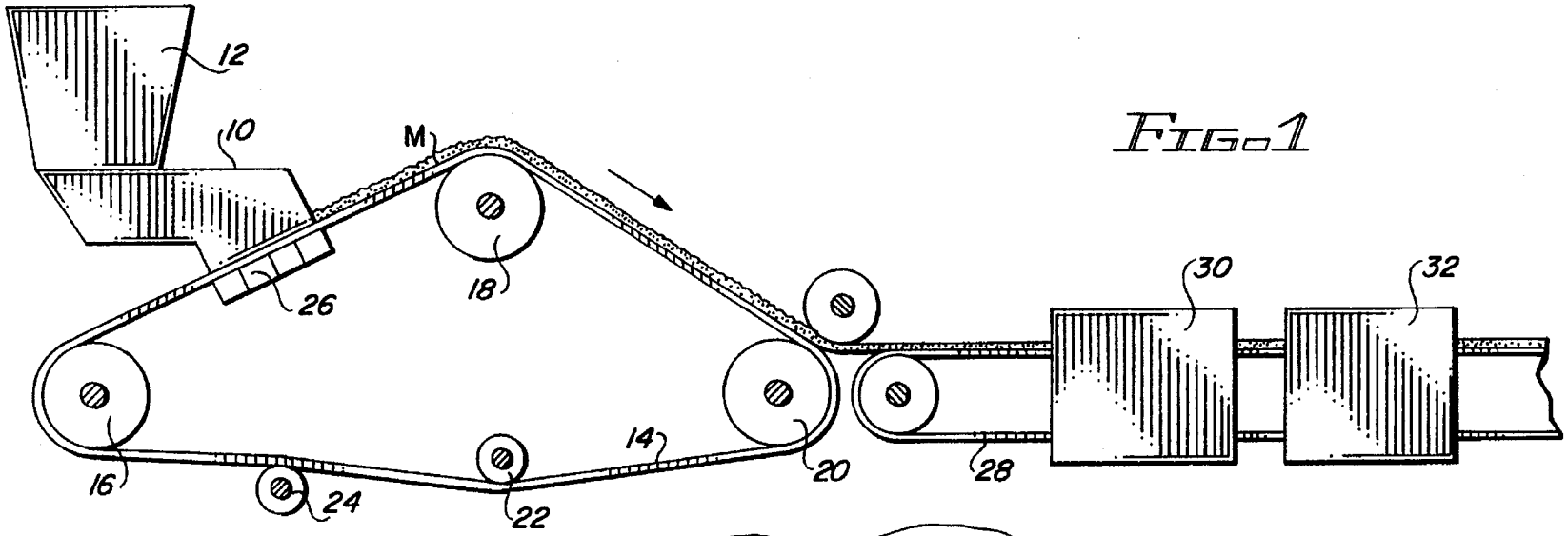
FIG. 1 is a schematic representation of a nonwoven mat forming operation adapted to carry out the present invention.

As previously mentioned, nonwoven fibrous mats are typically formed by means of a so-called wet operation in which a fibrous slurry is deposited on a moving screen. A typical screen is comprised of polyester and/or nylon monofilaments or "wires" woven in an open weave. Such an operation is schematically illustrated in FIG. 1, wherein a headbox 10 receives an aqueous fibrous slurry which has been mixed in the tank 12. The slurry consists of fibers, such as glass fibers, water and chemicals which have been added to the water to aid in the dispersal of the fibers. The particular mixer employed and the specific chemicals added to the water are not described herein since these aspects of the method are well known in the art, as disclosed in U.S. Pat. No. 4,112,174, which patent is herein incorporated by reference. This invention can also be practiced on the well known cylinder machine process.

An endless forming screen 14 travels about a path defined by a number of rolls, which have been shown for purposes of illustration as comprising larger rolls 16, 18 and 20 and smaller guide rolls 22 and 24. One of the larger rolls is mounted on a powered shaft and drives the screen. The screen moves through the end of the headbox 10 where it is exposed to the slurry. A series of vacuum boxes 26 located beneath the moving screen in the area of the headbox assists in drawing water from the slurry through the screen, leaving a wet layer or mat M of fibers on the moving screen. The mat is then transferred from the moving screen 14 to a conveyor 28, which transports the mat through a binder application station 30 and a drying oven 32. The final mat product exits from the drier and may be subjected to further operations, which do not form part of the present invention, such as being cut or trimmed to size or combined with other elements in the manufacture of a final product incorporating the mat as an element.

A forming screen of the type conventionally employed in the manufacture of wet-laid fibrous products is a woven wire mesh screen which is sufficiently flexible to be trained about its guide rolls. As is well known in the art, the wires are spaced to allow water in a fibrous slurry fed to the screen to drain through the screen while retaining the fibers on the upper surface of the screen.

Figure 2:
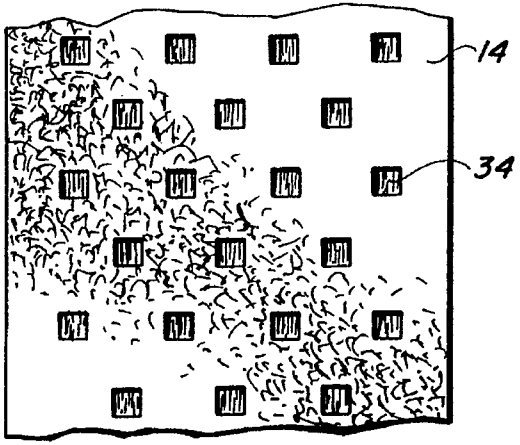
FIG. 2 is an enlarged plan view of a portion of an illustrative forming screen or wire which can be used in carrying out the invention.

In accordance with the invention, discrete areas of the screen are formed or treated so as to restrict drainage through those areas compared to the drainage through adjacent untreated areas. As shown in FIG. 2, the screen 14 contains areas 34 which are slower draining than the main body of the screen. As noted above, when a fibrous slurry stock is introduced to the moving screen or wire at a relatively slow rate compared to the speed of the wire, the fibers become oriented in the machine direction, and when the stock is introduced at a relatively fast rate compared to the speed of the wire, the fibers are distributed on the wire in random orientation. The slower draining areas of the screen result in a lesser quantity of fibers being collected on the screen in those areas. This in turn causes the fibers in areas of the mat corresponding to the reduced drainage areas of the forming screen to be slightly more aligned in the machine direction.

Figure 3:
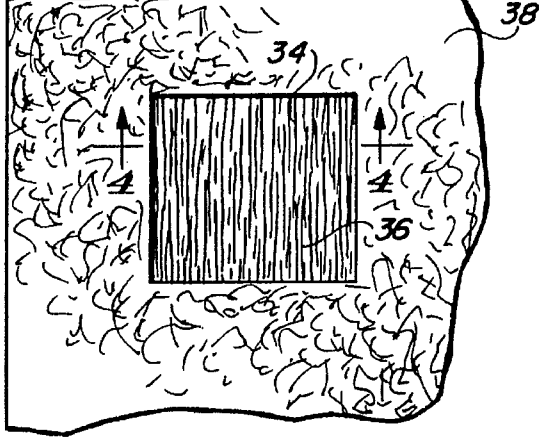
FIG. 3 is an enlarged plan view of a portion of a fibrous mat formed through use of the forming screen of FIG. 2.
Figure 4:
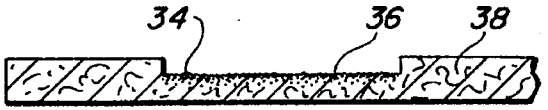
FIG. 4 is an enlarged transverse sectional view taken on line 4—4 of FIG. 3.

The fiber deposition on the screen between the slower draining areas will be much greater than on the screen in the slower draining areas. When the slower draining areas are relatively close together, the fiber deposition in the narrow regions between them will be locally oriented, i.e.,the fibers will tend to lie generally parallel to the adjacent sides of the discrete areas and be generally aligned in the machine direction, while the fibers corresponding to the untreated areas of the forming screen are more randomly oriented. The fibers within a slow draining area are indicated in FIG. 3 as the fibers 36, while the fibers in the untreated areas of the screen are indicated at 38. As illustrated in FIG. 4, the areas of the mat corresponding to the areas of reduced drainage on the forming screen are of less thickness than the main body of the mat as a result of the lesser amount of fiber retention in those areas.

Figure 5:
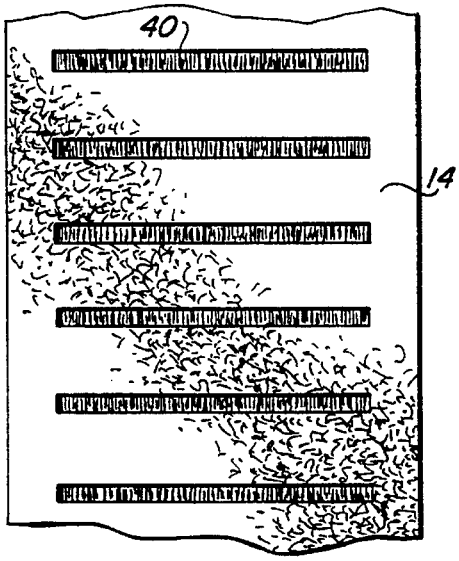
FIG. 5 is an enlarged plan view of a portion of another illustrative forming screen which can be used in carrying out the invention.
Figure 6:
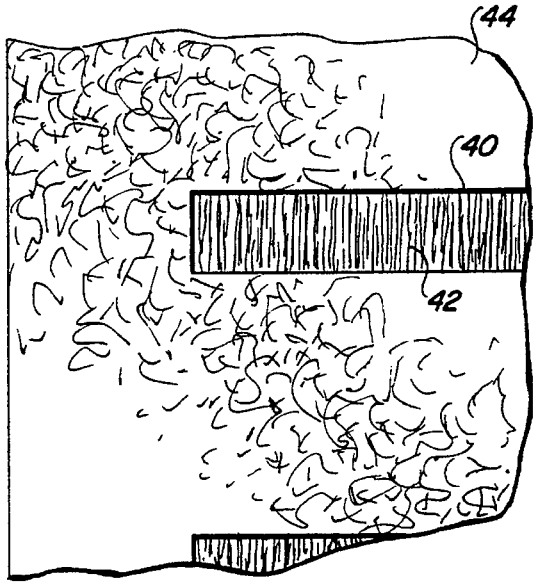
FIG. 6 is an enlarged plan view of a portion of a fibrous mat formed through use of the forming screen of FIG. 5.
Figure 7:
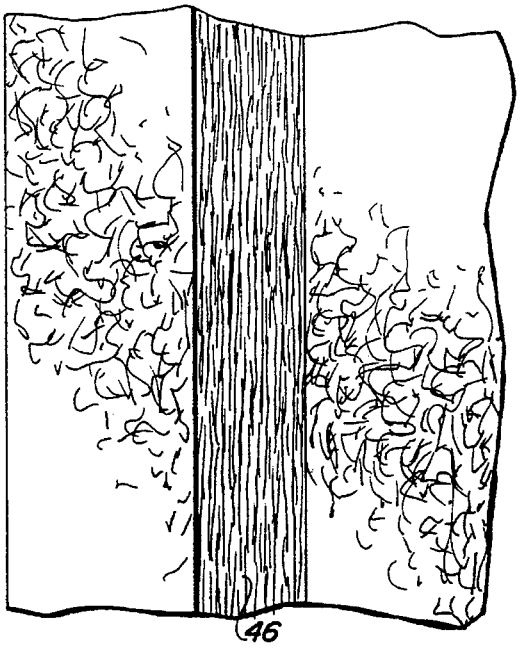
FIG. 7 is an enlarged plan view of a portion of a fibrous mat formed with another modified forming screen.

While the invention may be utilized to produce a mat having areas of different appearance in order to provide a variety of decorative effects, as illustrated by the pattern of restricted drainage of FIG. 2, the physical properties of a mat may also be modified. As shown in FIG. 5, the forming screen 14 has been provided with elongated areas 40 of restricted drainage to produce the alignment of fibers 42 illustrated in the mat of FIG. 6. As compared with the random arrangement of fibers 44 in the mat, the fibers 42 are aligned in the machine direction. The aligned fibers 42 would thus provide greater resistance to tearing when the mat is subjected to forces in the direction perpendicular to fibers 42. It will be appreciated that the areas of restricted drainage in the mat can extend in the machine direction as well, resulting in a mat having areas of fiber alignment as illustrated in FIG. 7, wherein the fibers 46 are aligned in the direction of the elongated areas. Such a mat provides additional tensile strength in the machine direction of the mat.

Figure 8:
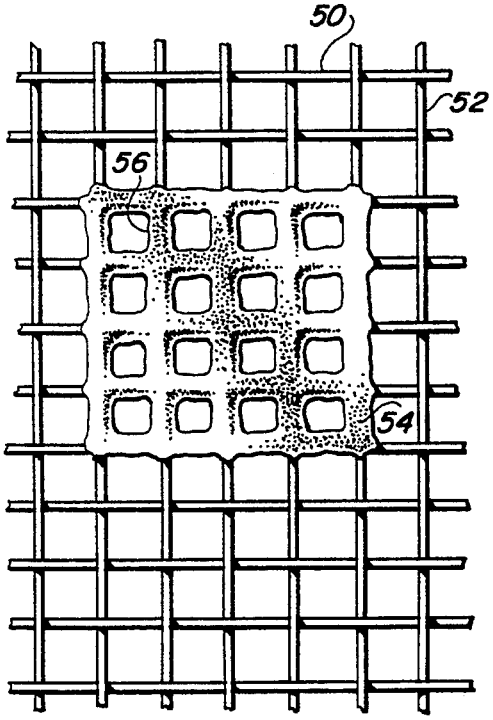
FIG. 8 is an enlarged plan view of a portion of a forming screen which has been coated with a substance to make the screen more restrictive to the flow of water.

FIG. 8 illustrates a method of creating areas of restricted flow in a forming screen by employing a coating substance. The screen is illustrated in simplified form as being comprised of woven wires 50 and 52, to which a coating 54 has been applied in the desired area of restricted drainage. The coating may be comprised of any material which has the ability to adhere to the screen wire without completely sealing off the spaces between the wires. The coating material has been applied to the screen in an amount which coats the wires, leaving openings 56 of reduced size between the coated wires. The size of the openings can be controlled through selection of the coating material and the thickness of the coating layer. An example of a coating material of this type is an epoxy, vinyl plastisol or urethane based coating such as commercially available epoxy based paints. The coating should not be affected by the white water of the forming operation, it should adhere well to the forming wire and it preferably should be tough and flexible.

The method of restricting flow is not limited to use of a coating material. For example, flow may be restricted by flattening the wires in selected areas to make them wider and thus spaced closer together. Other methods of restricting flow which have not been illustrated include fusing wires together and selectively changing the weave, warp or shute wires of the screen in the areas of restricted flow. The latter method could include utilizing larger diameter wires in these areas or employing a tighter weave. The use of coating material to restrict flow is preferred due to its simplicity and the ability to control the degree of flow through selection of materials or the application of the coating material in different thicknesses.

It will be appreciated that the invention provides a simple, effective and economical method of manufacturing a nonwoven fibrous mat containing areas of lesser thickness and, if desired, areas in which the fibers are more directionally aligned than in the main body of the mat. This enables mats to be formed with a variety of different designs. By providing for areas in a mat which contain directionally oriented fibers aligned in a direction related to the intended application of the product, certain physical properties of the mat, such as the tensile strength or tear strength, may be enhanced.

It should now be apparent that the invention is not necessarily limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. In a method for forming a nonwoven fibrous mat of generally random fiber orientation, including the steps of forming an aqueous fibrous slurry, depositing the slurry onto a permeable support while the support is moving through a fiber deposition zone, and drawing water from the slurry through the permeable support to cause a layer of fibers from the slurry to remain on the support, the improvement comprising:

coating discrete areas of the permeable support with a substance which reduces the permeability of the permeable support to water so as to restrict, but not block, the flow of water therethrough compared to adjacent areas of the support while still maintaining enough flow through said discrete areas to permit the deposition of fibers from the slurry in said discrete areas.

2. The improvement of claim 1, wherein the substance comprises an epoxy paint.

3. The improvement of claim 1, wherein the introduction of the slurry to the permeable support and the speed of movement of the support through the fiber deposition zone are correlated to as to cause the fibers in a mat formed on the support to be randomly distributed in areas adjacent the discrete areas of the permeable support and arranged in substantially the same orientation within said discrete areas.

4. The improvement of claim 3, wherein the fibers within said discrete areas are substantially arranged in a direction corresponding to the direction of movement of the permeable support.

5. The improvement of claim 1, wherein the thickness of the mat in the discrete areas therein is less than the thickness of the mat in adjacent areas.

6. The improvement of claim 1, wherein the fibers in the slurry are comprised of glass fibers.

7. The improvement of claim 1, wherein the permeable support is comprised of a wire mesh screen, the substance coated thereon adhering to the wires of the screen to thereby reduce the spaces between the wires in the coated discrete areas of the screen.

* * * * *